US005159157A

United States Patent [19]

Diegmann

[11] Patent Number: 5,159,157

[45] Date of Patent: Oct. 27, 1992

[54] ELECTRICAL CABLE WITH ELEMENT OF HIGH TENSILE STRENGTH

[75] Inventor: Wolfgang Diegmann, Wuppertal, Fed. Rep. of Germany

[73] Assignee: Kabelwerke Reinshagen GmbH, Fed. Rep. of Germany

[21] Appl. No.: 679,048

[22] PCT Filed: Sep. 7, 1990

[86] PCT No.: PCT/DE90/00686

§ 371 Date: May 8, 1991

§ 102(e) Date: May 8, 1991

[87] PCT Pub. No.: WO91/04563

PCT Pub. Date: Apr. 4, 1991

[30] Foreign Application Priority Data

Sep. 12, 1989 [DE] Fed. Rep. of Germany ..... 3930496

[51] Int. Cl.[5] ..... H01B 7/28

[52] U.S. Cl. ..... 174/113 C; 174/23 R; 174/131 A

[58] Field of Search ..... 174/113 C, 131 R, 131 A, 174/121 R, 124 R, 23 R, 23 C

[56] References Cited

U.S. PATENT DOCUMENTS

| | | | |
|---|---|---|---|
| 2,325,549 | 7/1943 | Ryzowitz | 174/113 C |
| 2,507,508 | 3/1950 | Elliott et al. | 174/113 R X |
| 3,717,720 | 2/1973 | Snellman | 174/131 A |
| 3,803,339 | 4/1974 | Speekman | 174/23 C |
| 4,097,686 | 6/1978 | Gladenbeck et al. | 174/131 A |
| 4,312,260 | 1/1982 | Morieras | 174/121 R X |
| 4,861,947 | 8/1989 | Altermatt et al. | 174/113 C |
| 4,963,695 | 10/1990 | Maraino-Agostinelli et al. | 174/23 C |

FOREIGN PATENT DOCUMENTS

| | | | |
|---|---|---|---|
| 2519687 | 11/1976 | Fed. Rep. of Germany . | |
| 3330096 | 3/1985 | Fed. Rep. of Germany . | |
| 838494 | 6/1960 | United Kingdom | 174/131 A |

*Primary Examiner*—Morris H. Nimmo

*Attorney, Agent, or Firm*—Reising, Ethington, Barnard, Perry & Milton

[57] ABSTRACT

To minimize the cross-sectional area or the diameter of an electric line that is under tensile stress, a central fibrous element of a carbon fiber bundle is disclosed. This can be designed so it is resistant to the longitudinal entry of water.

3 Claims, 1 Drawing Sheet

ELECTRICAL CABLE WITH ELEMENT OF HIGH TENSILE STRENGTH

FIELD OF THE INVENTION

This invention concerns an electric line with insulation, and with a multiwire conductor or lead of metal that is shaped into a strand or cable and with a fibrous element that has tensile strength arranged centrally in the lead.

BACKGROUND OF THE INVENTION

Electric lines of the type described above are already known. For example, German Patent 2,519,687 A1 describes a process for producing a line with strands for electric power line connections, etc., whereby a thin fiber of spun glass silk is used as a central strand when wrapping the cable of individual wires. With such lines the stranded lines consist of about thirty to sixty individual lines twisted together. The centrally inserted glass fiber especially increases the tensile strength of the cable without resulting in any significant increase in the cross-sectional area because it is embedded into the cavity (wedge) between the individual wires in the process of cabling or stranding.

Such a central glass fiber can be removed very easily when processing on cutting machines and leads to disturbance in the work sequence. In addition, embedding between numerous individual lines is not permanent if the finished line is bent frequently during use. Then the enclosed glass fiber can easily escape from the stranded cable and break.

This invention concerns the problem of creating an electric line than can withstand an extreme tensile stress even while having a small cross-section and that will be easy to produce and easy to process. In addition, if desired, it should be designed so it is resistant to longitudinal penetration of water in a simple and permanent manner.

SUMMARY OF THE INVENTION

This invention creates an electric line that can be designed so it is extremely small and yet can withstand extreme tensile stresses. It can be produced economically, can be processed further with no problem and can be designed so it has flexural stability and is sealed with respect to longitudinal seepage of water.

According to this invention the fibrous element consists of a bundle of carbon fiber elements (carbon fibers). When the bundle is divided into at least eight hundred single filaments or even one thousand to twelve thousand monofilaments depending on the design, where each filament has a maximum diameter of 0.007 millimeters, the carbon fibers can be optimally distributed in the internal wedges and can fill out all the cavities. The highest tensile force is achieved when the bundle has a twist. To improve processability of the bundle, the carbon fiber filaments may be shaped into a yarn with a twist of up to sixty d/m (turns per meter). For the same purpose, the bundle may also be provided with sizing, e.g., a polymer-based sizing or adhesive, to hold the individual filaments together by gluing, especially at the points of contact or line of contacts with each other. Such a sizing can be applied by the manufacturer of the bundle. In the simplest design, the conductor or lead is composed of a ring-shaped layer of at least six individual wires, that surround the bundle with a radial pressure, so the internal wedge is completely filled up by the individual filaments of the bundle.

Additional wires or other line elements can also be applied over the layer of individual wires. With increased demands of the line, the bundle can be filled with a liquid, paste or powdered material. Such a filling material greatly reduces the friction occurring between the individual filaments, so it has a positive effect on the flexibility of the line and on the stability of the filaments under bending stresses. Filling compounds that also cause a longitudinal sealing of the line can also be used in that they form a barrier to liquid by swelling, foaming or by some other reaction on exposure to water or any other liquid. Such fillers are available based on vaseline, petrojelly, silicones, cellulose and other materials. A process for producing a line according to this invention provides for at least one layer of wires to be stranded or cabled around a central bundle of carbon fiber filaments in such a way that these wires are in close contact with the bundle, and the insulation is arranged around the wires. Then other layers of wires or other line components can be introduced between the wire layer and the insulation, e.g., for the purpose of reinforcement, shielding, etc.

To produce a filled line, at least one layer of wires is cabled around a bundle of carbon fiber filaments provided with a filling compound in such a way that the wires are in close contact with bundle and insulation is provided around the wires under a radial pressure so that all outside wedges of between wires are filled. The bundle can be filled by guiding it through a filling device directly before applying the wires and the bundle is impregnated and coated with the filling compound. If additional line elements are introduced, they must either be free of cavities or must also be provided with a corresponding filling compound.

It is advisable to guide the bundle directly, before applying the (first) layer of wires, through a filling system where the bundle is impregnated with the filling compound.

A complete understanding of the invention may be obtained from the detailed description that follows taken with the accompanying drawings.

DESCRIPTION OF THE DRAWINGS

The Figures show one practical example of this invention, which is described in greater detail below. The line according to this invention is compared with a traditional line of the same tensile strength.

BEST MODE FOR CARRYING OUT THE INVENTION

Figure 1:
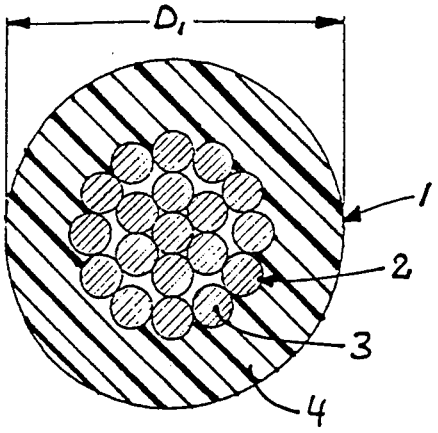
FIG. 1 shows a traditional electric line in cross-sectional view.

FIG. 1 shows an electric line 1 that consists of a cabled copper strand 2 of nineteen wires 3 laid in a design of 1+6+12 wires with a diameter of 0.18 mm and insulation 4 of polyvinyl chloride. The diameter of the line is 1.5 mm, its cross-sectional area is 1.77 $mm^2$. The total cross-sectional area of the nineteen wires is about 0.5 $mm^2$, and the tensile force is about 130 newtons.

There are applications where such line cross-sections are selected merely for reasons of tensile stress and/or flexibility. A much smaller line cross-section would be sufficient for electric transmission.

Figure 2:
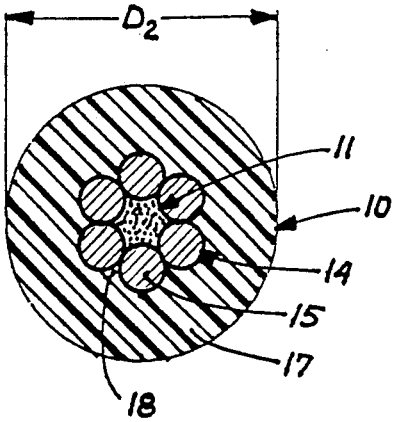
FIG. 2 shows an electric line according to this invention in cross-sectional view.
Figure 3:
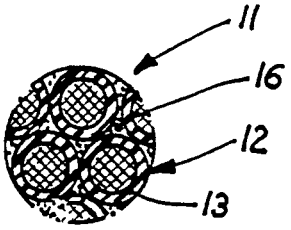
FIG. 3 shows a detail of the central fibrous element with three individual filaments.

FIG. 2 shows an electric line 10 that consists of a central carbon fiber bundle 11 with a diameter of about 0.2 mm consisting of about 1000 monofilaments 12 with a diameter of about 1/7000 of a millimeter each. The individual filaments 12 have a polymer-based sizing 13 that causes the individual filaments 12 to adhere to each other and it also has a twist of about 7 d/m (turns per meter).

Bundle 11 is surrounded by a layer 14 of six copper wires 15. The copper wires 15 have a diameter of about 0.2 mm, resulting in a total cross-sectional area for the six wires of about 0.2 $mm^2$. All the cavities within layer 14 of wires 15 and between the individual filaments 13 of bundle 11 are filled by a filling agent 16 based on vaseline.

Layer 14 of copper wires 15 is surrounded by an insulation 17 of polyvinyl chloride, which completely fills up the outer wedge 18. The diameter of line 10 is 1.19 mm, and its cross-sectional area is 1.11 $mm^2$. The tensile force is 120 Newtons.

The new line thus has a diameter that is reduced by about twenty-one percent at approximately the same tensile force, and the cross-sectional area is reduced by thirty-eight percent. These are values that can be a great advantage in cases where it is important to save space or weight and thus these values can constitute an important advantage. These new lines can be processed further with no problem because the central carbon fiber does not cause any interference. Stripping the insulation, crimping, welding and soldering can be performed without any negative effects, so this line is especially suitable for producing cable sets of all types.

To produce line 10 the six copper wires 15 and carbon fiber bundle 11 are sent to a cabling device. Before the cabling point, the bundle 11 is filled with a filling compound and coated in a stuffing device. The wires 15 are cabled around the central bundle 11 in the cabling device. The monofilaments 12 of bundle 11 have an individual length of twist of about 15 mm and the bundle is compressed radially, so all the inside wedges and all of the space enclosed by wires 15 is filled by bundle 11, i.e., by the individual filaments 12 and the filling compound 16. Then the stranded cable thus produced is passed through an extruder and coated with plastic insulation 17 such as PVC under a radial pressure. In doing so, the insulation material fills up all the outer wedges 18 so that no cavities are left.

The embodiment described here illustrates only a simple application of this invention. This invention can also be used for multiline round or flat lines that can serve a variety of purposes, e.g., for power transmission or communications transmission, for control purposes or measurement purposes.

Since carbon fibers conduct electricity, they cannot develop any interfering insulation layers at the contact points as is the case with other nonmetallic reinforcing fibers.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. In an electric line of the type comprising a multistranded cable of metal wires, a central fibrous element for providing tensile strength to the line and being disposed in the center of the cable and a layer of insulation around the cable, the improvement wherein the fibrous element is formed from a bundle of carbon fiber filaments, said bundle comprises at least eight hundred carbon fiber filaments each of which has a diameter of 0.007 millimeter or less, said bundle has a twist of zero to twenty turns per meter and being provided with a sizing that holds the individual filaments together, said cable has a ring-shaped layer of six individual wires that surround said bundle with the space within the wires being optimally filled by the fiber filaments, and said layer of insulation surrounds said ring-shaped layer and fills the outer space between the wires.

2. An electric line according to claim 1 wherein said bundle is impregnated with a filling compound for forming a barrier to a liquid on exposure to said liquid by a reaction thereto.

3. An electric line according to claim 1 wherein said ring shaped layer of six individual wires exert a radial pressure on said bundle.

* * * * *

UNITED STATES PATENT AND TRADEMARK OFFICE

CERTIFICATE OF CORRECTION

PATENT NO. : 5,159,157

DATED : October 27, 1992

INVENTOR(S) : Wolfgang Diegmann

It is certified that error appears in the above-identified patent and that said Letters Patent is hereby corrected as shown below:

Column 4, lines 22, 24, 25 and 32 in each instance delete "cable" and insert -- conductor --.

Signed and Sealed this

Eighth Day of November, 1994

Bruce Lehman

*Attest:*

BRUCE LEHMAN

*Attesting Officer*

*Commissioner of Patents and Trademarks*